US005231712A

United States Patent [19]

Edwards et al.

[11] Patent Number: 5,231,712

[45] Date of Patent: Aug. 3, 1993

[54] BEDDING UNIT AND SPRINGS THEREFOR

[75] Inventors: Phillip K. Edwards, High Point; Burl T. Kenner, Jr., Greensboro, both of N.C.

[73] Assignee: Elite Support Systems, Inc., High Point, N.C.

[21] Appl. No.: 830,861

[22] Filed: Feb. 4, 1992

[51] Int. Cl.[5] ..... A47C 25/00; A47C 23/00; F16F 3/00

[52] U.S. Cl. ..... 5/247; 5/255; 5/267; 267/102

[58] Field of Search ..... 5/255, 247, 246, 254, 5/476, 239, 267; 267/102, 107

[56] References Cited

U.S. PATENT DOCUMENTS

| | | | |
|---|---|---|---|
| 2,568,829 | 9/1951 | Scott et al. . | |
| 2,669,293 | 2/1954 | Neely et al. | 267/107 |
| 2,843,191 | 7/1958 | Regan . | |
| 3,059,189 | 6/1963 | Slominski | 267/102 |
| 3,638,254 | 2/1972 | Falkenau . | |
| 3,953,903 | 5/1976 | Lawrence et al. . | |
| 4,101,993 | 7/1978 | Yates et al. | 5/267 |
| 4,339,834 | 7/1982 | Mizelle | 5/255 |
| 4,377,279 | 3/1983 | Schulz, Jr. et al. | 5/247 |
| 4,489,450 | 12/1984 | Miller | 5/249 |
| 4,654,905 | 4/1987 | Miller | 5/249 |
| 4,703,527 | 11/1987 | Mizelle | 5/247 |
| 4,770,397 | 9/1988 | Schulz, Jr. | 5/247 |
| 4,809,958 | 3/1989 | Schulz, Jr. | 5/247 |
| 4,903,949 | 2/1990 | Schulz, Jr. | 5/240 |
| 4,921,228 | 5/1990 | Lowe | 5/247 |
| 5,005,809 | 4/1991 | Harmon | 5/247 |

FOREIGN PATENT DOCUMENTS

| | | | |
|---|---|---|---|
| 1356432 | 6/1974 | United Kingdom | 267/102 |

*Primary Examiner*—Alexander Grosz
*Attorney, Agent, or Firm*—Beveridge, DeGrandi, Weilacher & Young

[57] ABSTRACT

A bedding spring is formed of a single piece of sinuous wire with a plurality of bars connected together by bends. A top portion of the spring includes two inboard bars and two outboard bars which connect the spring to a wire grid. The outboard bars lie below a grid wire, the inboard bars lie above the grid wire, and the inboard bars have localized bends which form downwardly facing notches for receiving the grid wire. The spring has a bottom portion formed of two spaced apart feet which are connectable to a horizontal platform, and a midportion formed of two downwardly diverging sinuous wire sections which connect the top portion to the feet. A bedding unit is made from a horizontal platform, a wire grid, and plurality of such springs which have their bottom portions connected to the platform and their top portions connected to the grid.

17 Claims, 2 Drawing Sheets

BEDDING UNIT AND SPRINGS THEREFOR

BACKGROUND OF THE INVENTION

This invention relates to bedding products and particularly to a novel bedding unit and a novel spring configuration for use in such a bedding unit.

There are many types of bedding unit springs, the most notable of which are helical springs and so-called "formed-wire springs." The latter generally have a number of linear sections located in mutually perpendicular vertical planes, connected together by bends in order to achieve a desired effect. Bedding springs are normally stapled to a horizontal wooden platform, and their upper portions are connected to a wire grid assembly which has a rectangular border wire, longitudinally extending longwires, and transversely extending crosswires. Conventional clips are normally used to connect the upper ends of the springs to the grid wires but, in some instances, springs have been provided with self-connecting features as exemplified by U.S. Pat. Nos. 4,339,834, and 4,703,527.

There have been prior proposals to make bedding springs of sinuous wire of a type well known in the industry by the trademark NO-SAG. These springs are normally used in seating units. They are formed are formed of a plurality of bars which are connected by semicircular bends known in the furniture industry as "convolutions."

The present invention introduces a novel type of sinuous wire spring for bedding units. The spring is relatively inexpensive, conveniently attached to a wire grid, pivotable to a storage position to conserve volume when a plurality of grid-and-spring assemblies are stored or transported, and effective for its intended purpose while in normal use in a box spring or other bedding unit.

SUMMARY OF THE INVENTION

According to the invention, the spring is a single piece of wire which includes a plurality of longitudinally extending bars or sections which are connected by bends to form the spring. A bottom portion of the spring is connectable to a platform, a top portion of the spring is connectable to a grid, and a midportion connects the top portion to the bottom portion. The top portion includes four horizontal bars which substantially lie in a same horizontal plane. At least two of the horizontal bars in the top portion have localized bends which form vertically facing notches for receiving grid wires so that a horizontal grid wire which is transverse to the horizontal bars in the top portion will be held resiliently in the notches, thus avoiding the necessity for clips to attach the spring to the grid.

The invention also includes a bedding unit, typically a box spring unit, which has a plurality of such springs mounted on a horizontal platform, and a horizontal grid which is formed of mutually perpendicular grid wires and is mounted on and supported by the springs. Two of the horizontal bars in the top portion of each spring lie above a grid wire, and two such bars lie below the respective grid wire.

Preferably, the bars are substantially straight and horizontal. The top portion of the spring has two inboard bars and two outboard bars for engaging a grid wire which is substantially perpendicular to the bars. The inboard bars and outboard bars lie in opposite vertical directions from the grid wire. Preferably, the notches are formed in the inboard bars and they face downwardly. The distance between adjacent bars in the spring is preferably in the range of about 13/16 inch to 2-¼inch, and the longitudinal dimension of the spring is about 1 to 3 inches.

Other significant aspects of the invention will be recognized by persons skilled in the art upon reading this specification and inspecting the appended drawings.

DETAILED DESCRIPTION

Figure 1:
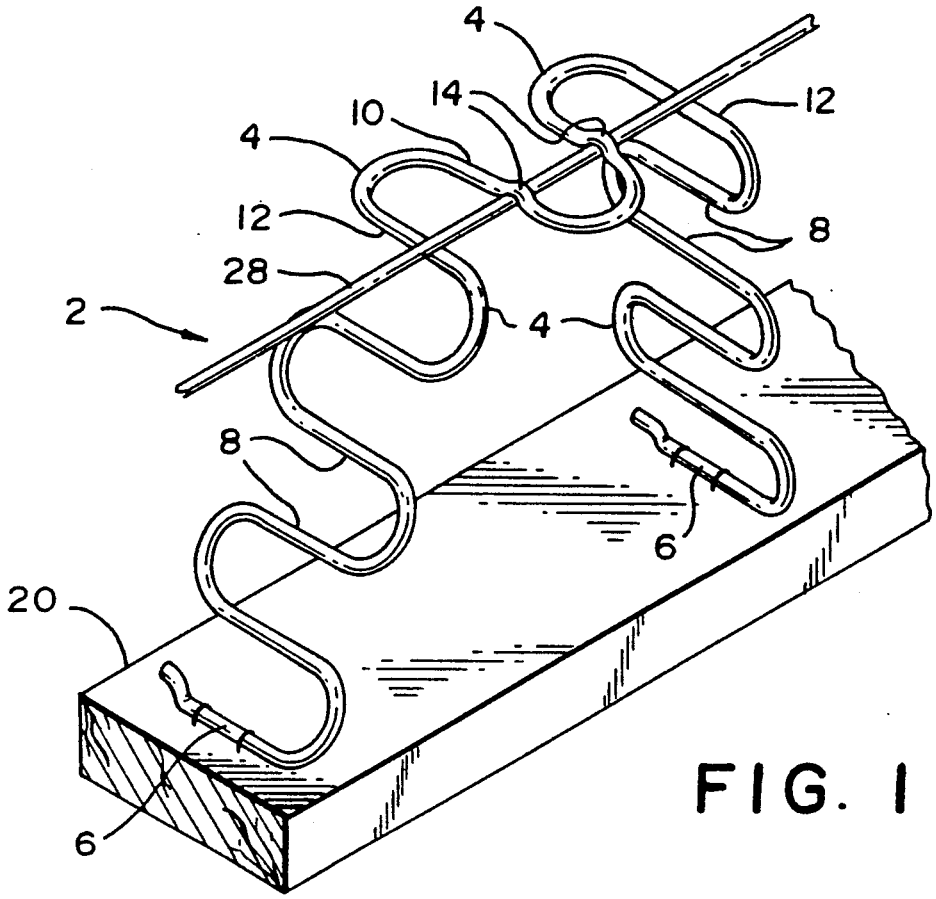
FIG. 1 is a perspective view of a spring constructed according to the invention, mounted on a slat and connected to a grid wire.

As mentioned previously, the spring according to the invention is formed of what is known as sinuous wire in the furniture industry. As shown in FIGS. 1–4, the spring 2 is a single piece of wire including a plurality of longitudinally extending bars which are connected together by convolutions or bends 4. The bottom portion of the spring includes two bars 6 which serve as feet, located at opposite ends of the wire. These feet are connectable to a platform of a bedding unit by staples or otherwise. The bars in the midportion of the spring are identified by the reference numeral 8. The two halves of the spring are mirror images of each other.

The top portion of the spring has two inboard bars 10 and two outboard bars 12, all of which lie in substantially the same horizontal plane. The inboard bars 10 have localized embossments or bends 14 which form vertically facing notches 16. A grid wire is engaged by all bars 10 and 12, with the inboard bars and outboard bars lying in opposite vertical directions from the grid wire. Preferably, the inboard bars are above the grid wire 28 and the outboard bars are below it as shown in FIG. 1.

As illustrated, the notches 16 are formed in the inboard bars and they face downwardly. Additionally or alternatively, upwardly-facing notches may be formed in the two outboard bars 12. In any case, when the spring is in an unstressed condition prior to its attachment to the grid, the portion of a notch 16 which is exposed in a side view (FIG. 4) has a height which is smaller than the diameter of the grid wire which will be connected to the spring.

Figure 5:
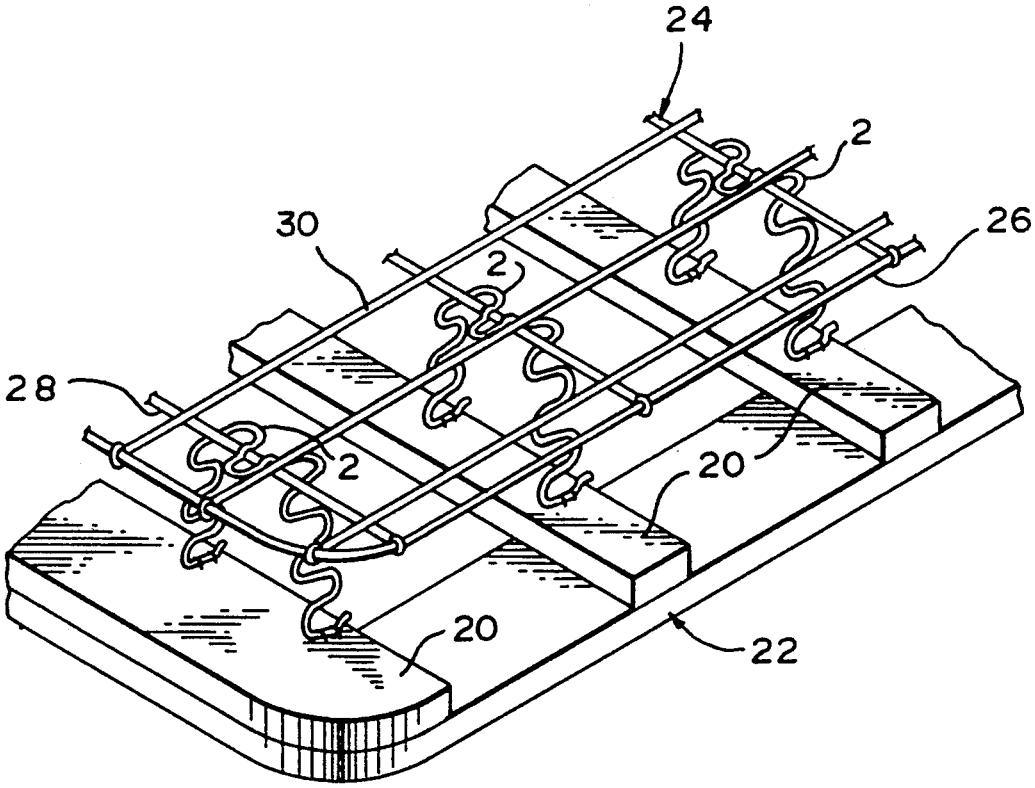
FIG. 5 is a fragmentary view of a portion of a bedding unit which incorporates springs according to the invention.
Figure 2:
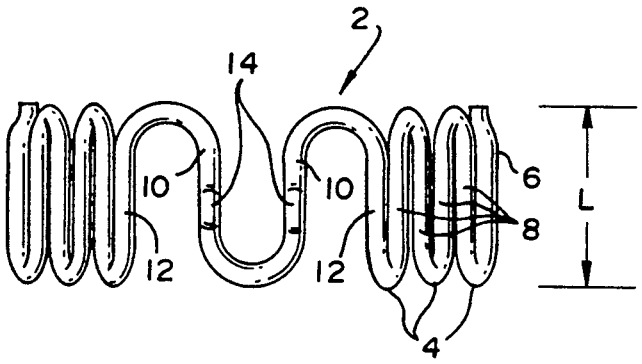
FIG. 2 is a top view of the spring.

To attach the spring to a crosswire of the grid, the spring is forced against the grid wire so that the inboard bars 10 are above the grid wire, and the outboard bars 12 are below the grid wire. The springs will be normally attached to crosswires, preferably in locations where one of the longwires will lie between adjacent inboard and outboard bars 10 and 12 so that the spring cannot slide along the crosswire by a distance which is greater than the distance between the bars 10 and 12. FIG. 5 shows springs stapled to slats 20 of a horizontal platform 22, and connected to a welded wire grid 24 which has a rectangular border wire 26, crosswires 28, and longwires 30.

After a spring is connected to a grid wire, the resilience of the spring wire will cause the inboard bars to bear down against the crosswire and the outboard bars to bear up against the crosswire, thus retaining the crosswire securely in the notches 16. Until such time that the lower portion of the spring is stapled or otherwise connected to a platform, the spring is pivotally supported on the crosswire so it can swing to the orientation indicated in broken lines in FIG. 4. This reduces the total height of the grid-and-spring assembly, so that a plurality of grids with attached springs can be stacked in a manner to minimize their total height for transportation and/or storage. When such assemblies arrive at the final manufacturing site, each of the springs is pivoted to the upright position illustrated in solid lines in FIG. 4, the bottom portion of the spring is stapled or otherwise connected to the platform, and conventional padding and ticking are applied as is customary in the industry.

Figure 3:
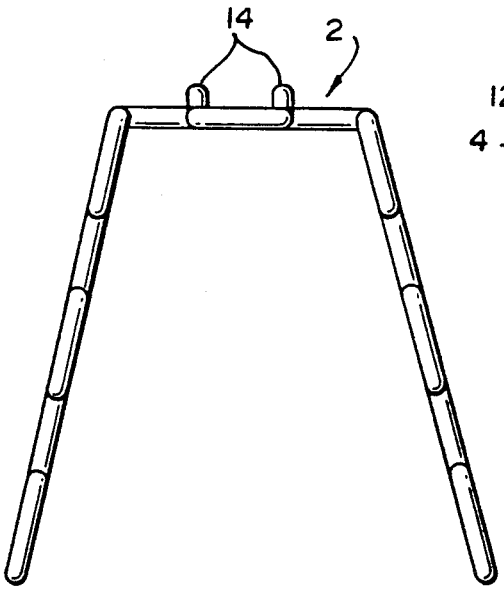
FIG. 3 is a front view thereof.
Figure 4:
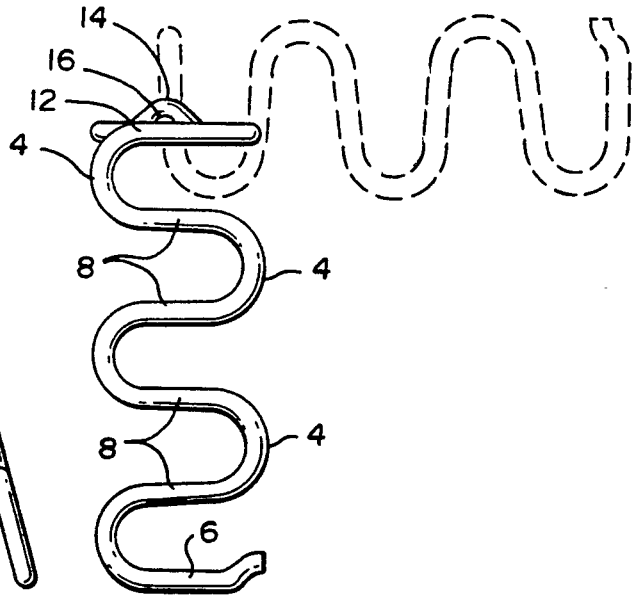
FIG. 4 is a side view thereof.

The springs are preferably made from 7-½to 12 gauge wire. The bar-to-bar spacing (the distance from the center of one bar to the center of the next bar) can be about from 13/16 inch to 2-¼inch, and the longitudinal dimensions of the spring (L in FIG. 2) can range from 1 to 3 inches. The wire is manufactured in a conventional manner, and the spring is subjected to a heat treatment process which conforms to industry standards. The two legs or midportions of the spring, as shown in FIG. 3 are in downwardly diverging planes inclined from the horizontal from about 65 to about 85 degrees, preferably about 75°. When a vertical load is applied to the spring, this angulation provides lateral stability and adequate vertical support.

Persons familiar with the industry will recognize that the invention provides a relatively uncomplicated structure which is easily made using well-known techniques. It is easily attached to standard grids used in the industry, it is conveniently transported and stored, and it provides an effective final product at relatively low cost. Skilled persons will also recognize that the invention may take many forms other than the disclosed embodiment. Therefore, it is emphasized that the invention is not limited only to the disclosed embodiment but is embracing of modifications thereto and variations thereof which fall within the spirit of the following claims.

We claim:

1. A spring assembly for a bedding unit in which a plurality of such springs are mounted on a horizontal platform, and a horizontal grid is mounted on and supported by said springs, said grid being formed of grid wires, said spring assembly comprising:

a horizontal grid wire, a single piece of wire which includes a plurality of longitudinally extending bars which are connected together by bends to form the spring, said spring having a top portion connectable to a grid, a bottom portion connectable to a platform, and a midportion connecting the top portion to the bottom portion;

said top portion including four horizontal bars which substantially lie in a same horizontal plane and are substantially perpendicular to said grid wire, said grid wire having two inboard bars which are both located on one vertical side thereof and two outboard bars which are both located on an opposite side thereof, so that grid wire is vertically between said outboard wires and said inboard wires, at least two of said horizontal bars in said top portion having localized bends which form vertically facing notches for receiving grid wires so that a horizontal grid wire which is transverse to said horizontal bars in said top portion will be held resiliently in said notches.

2. A spring assembly according to claim 1, wherein the bars are substantially horizontal.

3. A spring assembly to claim 1, wherein said top portion has only four said bars.

4. A spring assembly according to claim 1, wherein the notches are downwardly facing notches in the inboard bars.

5. A spring assembly according to claim 1, wherein adjacent said bars are spaced apart by a distance of about 13/16 inch to about 2-¼inch.

6. A spring assembly according to claim 1, wherein the spring has a longitudinal dimension of about 1 to 3 inches.

7. A spring assembly according to claim 1, wherein the midportions lie in planes which diverge downwardly and are oriented at inclinations of about 65° to 85° from horizontal.

8. A spring assembly according to claim 1, wherein the spring has two halves which are mirror images of each other.

9. A spring assembly according to claim 1, in combination with a horizontal platform and a horizontal grid formed of grid wires, said spring having its bottom portion connected to the platform and its top portion connected to the grid.

10. A bedding unit, comprising, a horizontal platform, a plurality of springs mounted on said horizontal platform, a horizontal grid mounted on and supported by said springs, said grid being formed of grid wires, said spring including the following:

a single piece of wire which includes a plurality of longitudinally extending bars which are connected together by bends to form the springs, a top portion connected to said grid, a bottom portion connected to said platform, and a midportion connecting the top portion to the bottom portion:

said top portion including four horizontal bars which substantially lie in a same horizontal plane and are substantially perpendicular to one of said grid wires, said one of said grid wires having two inboard bars which are both located on one vertical side thereof and two outboard bars which are both located on an opposite side thereof, so that said grid wire is vertically between said outboard wires and said inboard wires, at least two of said horizontal bars in said top portion having localized bends which form vertically facing notches which receive said one of said grid wires to hold said grid wire resiliently in said notches.

11. A bedding unit according to claim 10, wherein said bars of each said spring are substantially horizontal.

12. A bedding unit according to claim 10, wherein said top portion of each spring has only four said bars.

13. A bedding unit according to claim 10, wherein the notches of each said spring are downwardly facing notches in the inboard bars.

14. A bedding unit according to claim 10, wherein adjacent bars of each said spring are spaced apart by a distance of about 13/16 inch to about 2-¼inch.

15. A bedding unit according to claim 10, wherein each said spring has a longitudinal dimension of about 1 to 3 inches.

16. A bedding unit according to claim 10, wherein the midportions of each said spring lie in planes which diverge downwardly and are oriented at inclinations of about 65° to 85° from horizontal.

17. A bedding unit according to claim 10, wherein each said spring has two halves which are mirror images of each other.

* * * * *